US008739511B1

(12) United States Patent
Toqan et al.

(10) Patent No.: US 8,739,511 B1
(45) Date of Patent: Jun. 3, 2014

(54) CAN-ANNULAR COMBUSTOR WITH STAGED AND TANGENTIAL FUEL-AIR NOZZLES FOR USE ON GAS TURBINE ENGINES

(76) Inventors: Majed Toqan, Abu Dhabi (AE); Brent Allan Gregory, Scottsdale, AZ (US); Jonathan David Regele, Fountain Hills, AZ (US); Ryan Sadao Yamane, Gilbert, AZ (US)

( * ) Notice: Subject to any disclaimer, the term of this patent is extended or adjusted under 35 U.S.C. 154(b) by 475 days.

(21) Appl. No.: 12/772,353

(22) Filed: May 3, 2010

Related U.S. Application Data

(60) Provisional application No. 61/175,581, filed on May 5, 2009.

(51) Int. Cl.
*F02C 3/00* (2006.01)

(52) U.S. Cl.
USPC ..... 60/39.37

(58) Field of Classification Search
USPC ..... 60/39.37, 752–760
See application file for complete search history.

(56) References Cited

U.S. PATENT DOCUMENTS 4,356,693 A * 11/1982 Jeffery et al. ..... 60/39.37
4,476,194 A * 10/1984 Sanborn et al. ..... 428/585
5,687,572 A * 11/1997 Schrantz et al. ..... 60/753
5,746,048 A * 5/1998 Shah ..... 60/776

OTHER PUBLICATIONS

Arthur H. Lefebvre, Gas Turbine Combustion, Sep. 1, 1998 CRC Press, 2nd Edition, 8-10.*

* cited by examiner

*Primary Examiner* — Phutthiwat Wongwian
*Assistant Examiner* — William Breazeal
(74) *Attorney, Agent, or Firm* — Parsons & Goltry; Michael W. Goltry; Robert A. Parsons

(57) ABSTRACT

A combustion device used in gas turbine engines to produce propulsion or rotate a shaft for power generation includes a can-annular combustor with a system of fuel and air inlet passages and nozzles that results in an optimal combustion environment of fuel and air. Fuel, air and/or fuel-air inlets are placed at various longitudinal locations and circumferentially distributed, and direct the flow tangentially or nearly tangent to the can liner. The combustion device provides an optimal mixing of fuel and air, creates an environment for combustion that reduces pollutant emissions, reduces the need for costly pollution control devices, enhances ignition and flame stability, reduces piloting issues, and improves vibration reduction.

9 Claims, 5 Drawing Sheets

CAN-ANNULAR COMBUSTOR WITH STAGED AND TANGENTIAL FUEL-AIR NOZZLES FOR USE ON GAS TURBINE ENGINES

CROSS-REFERENCE TO RELATED APPLICATION

This application claims the benefit of U.S. Provisional Patent Application Ser. No. 61/175,581, filed May 5, 2009.

FIELD OF THE INVENTION

This invention relates to devices in gas turbine engines that aid in containing and producing the combustion of a fuel and air mixture. Such devices include but are not limited to fuel-air nozzles, combustor liners and casings and flow transition pieces that are used in military and commercial aircraft, power generation, and other gas turbine related applications.

BACKGROUND OF THE INVENTION

Gas turbine engines include machinery that extracts work from combustion gases flowing at very high temperatures, pressures and velocity. The extracted work can be used to drive a generator for power generation or for providing the required thrust for an aircraft. A typical gas turbine engine consists of a multistage compressor where the atmospheric air is compressed to high pressures. The compressed air is then mixed at a specified fuel/air ratio in a combustor wherein its temperature is increased. The high temperature and pressure combustion gases are then expanded through a turbine to extract work so as to provide the required thrust or drive a generator depending on the application. The turbine includes at least a single stage with each stage consisting of a row of blades and a row of vanes. The blades are circumferentially distributed on a rotating hub with the height of each blade covering the hot gas flow path. Each stage of non-rotating vanes is placed circumferentially, which also extends across the hot gas flow path. The included invention involves the combustor of gas turbine engines and components that introduce the fuel and air into the said device.

The combustor portion of a gas turbine engine can be of several different types: can/tubular, annular, and a combination of the two forming a can-annular combustor. It is in this component that the compressed fuel-air mixture passes through fuel-air swirlers or nozzles and a combustion reaction of the mixture takes place, creating a hot gas flow causing it to drop in density and accelerate downstream. The can type combustor typically comprises of individual, circumferentially spaced cans that contain the flame of each nozzle separately. Flow from each can is then directed through a duct and combined in an annular transition piece before it enters the first stage vane. In the annular combustor type, fuel-air nozzles are typically distributed circumferentially and introduce the mixture into a single annular chamber where combustion takes place. Flow simply exits the downstream end of the annulus into the first stage turbine, without the need for a transition piece. The key difference of the last type, a can-annular combustor, is that it has individual cans encompassed by an annular casing that contains the air being fed into each can. Each variation has its benefits and disadvantages, depending on the application.

In combustors for gas turbines, it is typical for the fuel-air nozzle to introduce a swirl to the mixture for several reasons. One is to enhance mixing and thus combustion, another reason is that adding swirl stabilizes the flame to prevent flame blow out and it allows for leaner fuel-air mixtures for reduced emissions. A fuel air nozzle can take on different configurations such as single to multiple annular inlets with swirling vanes on each one. As with other gas turbine components, implementation of cooling methods to prevent melting of the combustor material is needed. A typical method for cooling the combustor is effusion cooling, implemented by surrounding the combustion liner with an additional, offset liner, which between the two, compressor discharge air passes through and enters the hot gas flow path through dilution holes and cooling passages. This technique removes heat from the component as well as forms a thin boundary layer film of cool air between the liner and the combusting gases, preventing heat transfer to the liner. The dilution holes serve two purposes depending on its axial position on the liner: a dilution hole closer to the fuel-air nozzles will aid in the mixing of the gases to enhance combustion as well as provide unburned air for combustion, second, a hole that is placed closer to the turbine will cool the hot gas flow and can be designed to manipulate the combustor outlet temperature profile.

One can see that several methods and technologies can be incorporated into the design of combustors for gas turbine engines to improve combustion and lower emissions. While gas turbines tend to produce less pollution than other power generation methods, there is still room for improvement in this area. With government regulation of emissions tightening in several countries, the technology will need to improve to meet these requirements.

SUMMARY OF THE INVENTION

The above problems and others are at least partially solved and the above objects and others realized in a With regard to present invention, there is provided a novel and improved combustor design that is capable of operating in a typical fashion while minimizing the pollutant emissions that are a result of combustion of a fuel and air mixture and address other issues faced by such devices. The invention consists of a typical can-annular combustor with fuel and air nozzles and/or dilution holes that introduce the compressor discharge air and pressurized fuel into the combustor at various locations in the longitudinal and circumferential directions. The original feature of the invention is that the fuel and air nozzles are placed in such a way as to create an environment with enhanced mixing of combustion reactants and products. Staging the fuel and air nozzles to have upstream nozzles inject mainly fuel and another set of nozzles downstream which inject mainly air enhances the mixing of the combustion reactants and creates a specific oxygen concentration in the combustion region that greatly reduces the production of $NO_x$. In this device, there is no attached/anchored flame, but rather a region in the can near the front wall where diffusion combustion occurs. The novel configuration of separate fuel and air nozzles means that air that is injected downstream and propagations upstream will be diluted, thus reducing the oxygen concentration the flame sees and reducing peak flame temperatures. This is what makes the said invention capable of reducing emissions. In addition, the introduction of compressor discharge air downstream of the combustion region allows for any CO produced during combustion to be burned/consumed before entering the first stage turbine. In effect, the combustor will improve gas turbine emission levels, thus reducing the need for emission control devices as well as minimize the environmental impact of such devices. In addition to this improvement, the tangentially firing fuel and fuel-air nozzles directs any initial flame fronts to the adjacent burner nozzles in each can, greatly enhancing the ignition process of the combustor.

BRIEF DESCRIPTION OF THE DRAWINGS

Referring to the drawings.

DETAILED DESCRIPTION

Figure 1:
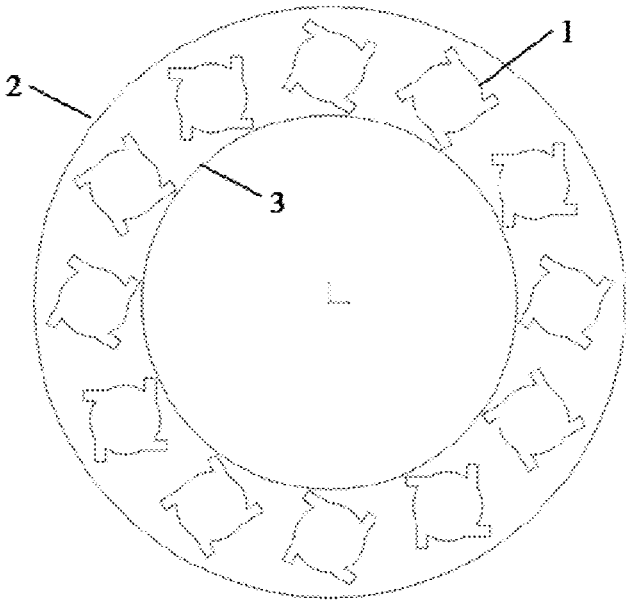
FIG. 1 is a two-dimensional sketch showing the can-annular arrangement with the nozzles that attach to the outer can liner injecting fuel and air into a common plane.
Figure 2:
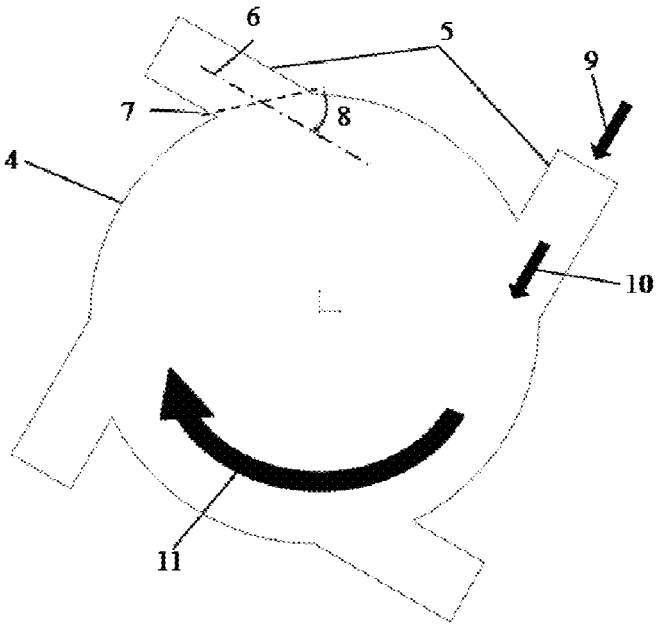
FIG. 2 is a two-dimensional sketch showing the general idea of the tangential nozzles applied to the can in a can-annular combustor.

FIG. 1 shows an example of the general arrangement of a can-annular combustor with the can 1 spaced circumferentially on a common radius, all cans of which are enclosed between a cylindrical outer liner 2 and a cylindrical inner liner 3. The FIG. also shows the tangential nozzle arrangement of the cans. FIG. 2 shows the can in more detail. A can liner 4 forms the can volume, with fuel/air nozzles 5 injecting either fuel or air. The nozzles form an angle 8 between the nozzle centerline 6 and a line tangent to the can liner 4 that intersections with the nozzle centerline 6. This angle defines the circumferential direction of the nozzles.

FIG. 2 also shows the general operation of the can in the example can-annular combustor configuration, where the fuel or air 9 is injected into the cans 1 at an angle 8. A flame 10, that is not anchored in this invention, forms and travels through the can in a path 11 that follows the can liner. These tangentially directed nozzles result in flow from each nozzle interacting with the downstream and adjacent nozzle. This key feature enhances ignition and reduces the issue of piloting multiple burner nozzles by allowing the flame to be directed from one nozzle to ignite the fuel at the adjacent and downstream nozzle.

Figure 3:
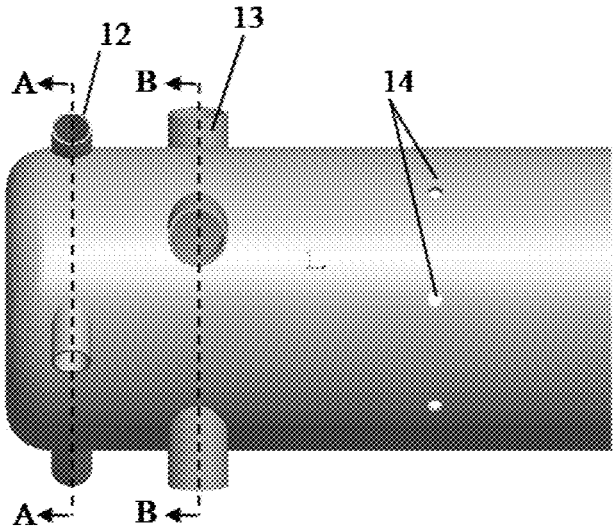
FIG. 3 is an isometric side view of the upstream portion of an example configuration of the said invention.
Figure 4A:
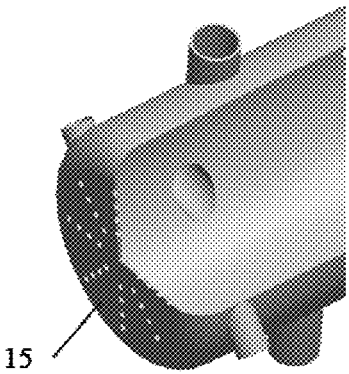
FIG. 4A is an isometric cutaway view of the invention.
Figure 4B:
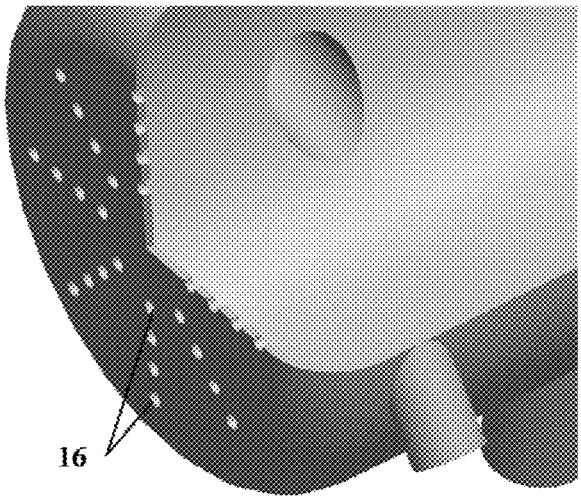
FIG. 4B is a close up view of the image from FIG. 4A.
Figure 5:
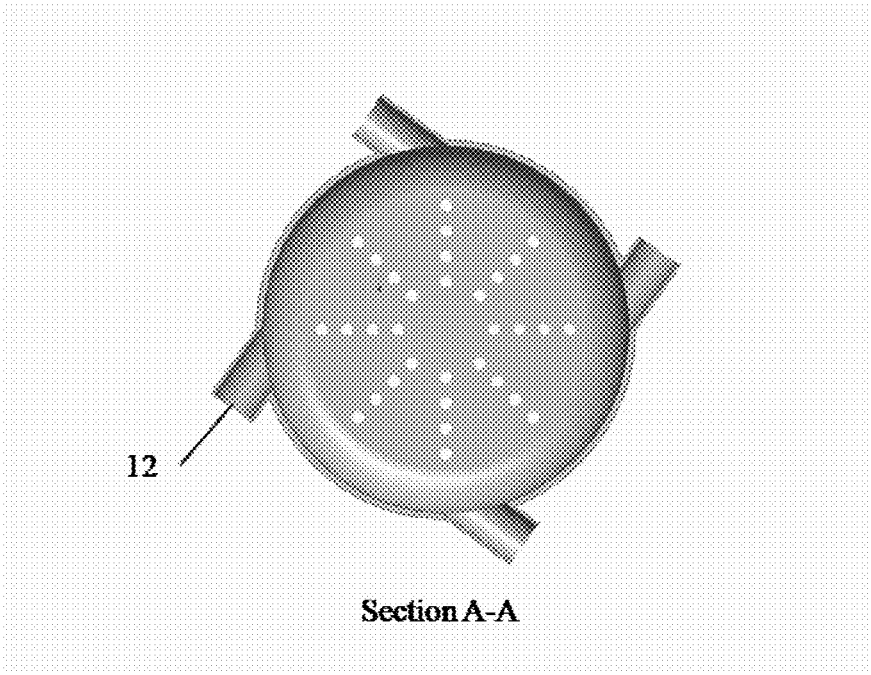
FIG. 5 is a section view showing section A-A as defined in FIG. 3.
Figure 6:
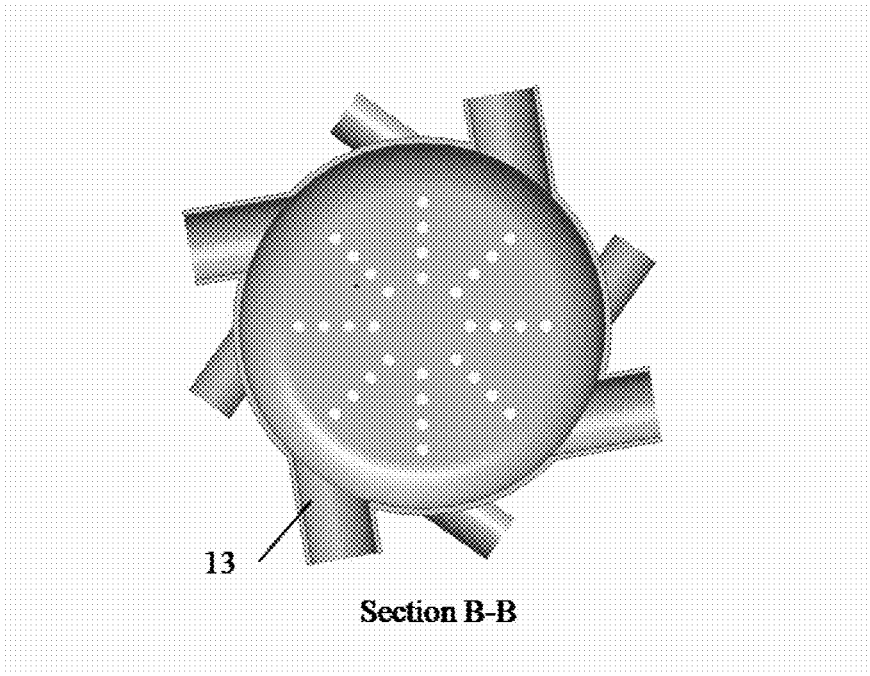
FIG. 6 is a section view showing section B-B as defined in FIG. 3.

FIG. 3 shows the beginning or upstream portion of an example can with the downstream portion excluded. The said invention will have a plurality of nozzle rows that are spaced along the longitudinal direction of the can. Each row of nozzles 12, 13 may have at least one nozzle and can be offset by a circumferential angle from adjacent nozzle rows. In particular, the nozzles 12 in the row close to the front wall 15 inject pure/mostly fuel into the can in a manner previously described, where as nozzles 13 downstream of these inject pure compressor discharge air or a fuel-air mixture into the can in a similar manner. The can may also have several rows of circumferentially spaced holes 14 or passages for cooling air to enter the can at any location. FIGS. 4A and 4B show the most upstream face 15 of the can, which may have holes 16 similar to dilution holes that allow compressor discharge air to enter the can. FIGS. 5 and 6 show how nozzles 12, 13 from each set of nozzles may be offset by a circumferential angle. The different rows of nozzles allows for the separate injection of the fuel and air creating a zone of combusting reactants near the front wall that does not see a high oxygen concentration, which in effect will reduce peak flame temperatures. Flue gases that travel upstream towards the front wall will be diluted from combustion products, making it possible for the combusting reactants to see a lower oxygen concentration. This combustion environment created by the staged fuel and air nozzles makes the reduced emissions possible.

The present invention is described above with reference to a preferred embodiment. However, those skilled in the art will recognize that changes and modifications may be made in the described embodiment without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. A can-annular combustor for a gas turbine used in ground based power generation, land or sea based vehicles or aircraft engine applications, comprising: a plurality of circumferentially spaced cans enclosed between two cylindrical liners, the cans define separate combustion zones and each can is a can liner, the can liner has an upstream end, including a front wall, and a downstream end, the combustion zone is a can volume of the can liner, the can volume extends in a longitudinal direction from the front wall of the upstream end of the can liner to the downstream end of the can liner, a plurality of dilution holes through the front wall to apply compressor discharge air into the can volume in the longitudinal direction of the can volume, a first set of tangentially pointing and circumferentially spaced first nozzles between the upstream and downstream ends of the can liner to inject one of an air component and a fuel-air component into the can volume in tangentially circumferential directions relative to the longitudinal direction of the can volume, and a second set of tangentially pointing and circumferentially spaced second nozzles between the first nozzles and the upstream end of the can liner to inject a fuel component into the can volume in tangentially circumferential directions relative to the longitudinal direction of the can volume between the plurality of dilution holes through the front wall of the upstream end of the can liner and the first nozzles.

2. The can-annular combustor as claimed in claim 1, further comprising circumferentially spaced cooling air holes through the can liner being positioned between the downstream end of the can liner and the first nozzles to circumferentially apply cooling air into the can volume between the downstream end of the can volume and the first nozzles.

3. The can-annular combustor as claimed in claim 1, the first nozzles and the second nozzles do not extend into the can volume.

4. The can-annular combustor as claimed in claim 1, wherein the first nozzles direct any flame to the next adjacent first nozzle to aid in the ignition of one another, and the second nozzles direct any flame to the next adjacent second nozzle to aid in the ignition of one another.

5. The can-annular combustor as claimed in claim 1, wherein the first nozzles and the second nozzles promote mixing of combustion components in the can volume.

6. The can-annular combustor as claimed in claim 1, wherein a uniform temperature distribution is achieved at an outlet of the combustor which allows for the combustor to operate at higher combustion temperatures without deteriorating combustor and turbine parts.

7. The can-annular combustor as claimed in claim 6, wherein an ability to operate at higher combustion temperature results in increased engine efficiency and power output and thus reduces carbon dioxide emission levels.

8. The can-annular combustor as claimed in claim 1, wherein the plurality of dilution holes allow compressor discharge air to penetrate the can liner at velocity magnitudes less than velocity magnitudes of the one of the air component and the fuel-air component into the can volume through each of the first nozzles.

9. The can-annular combustor as claimed in claim 1, wherein the first nozzles are circumferentially offset from the second nozzles.

* * * * *